US005116269A

United States Patent [19]

Moran

[11] Patent Number: 5,116,269

[45] Date of Patent: May 26, 1992

[54] BODYBOARD WITH SIDE GRIP CONTOUR

[75] Inventor: Steven M. Moran, Long Beach, Calif.

[73] Assignee: Kransco, San Francisco, Calif.

[21] Appl. No.: 660,416

[22] Filed: Feb. 22, 1991

[51] Int. Cl.[5] ..... B63C 9/08

[52] U.S. Cl. ..... 441/65; 441/129; D21/237

[58] Field of Search ..... D21/227, 228; 441/65, 441/68, 74, 70, 79; 114/357, 363

[56] References Cited

U.S. PATENT DOCUMENTS

| | | | |
|---|---|---|---|
| D. 246,066 | 8/1976 | O'Farrell | D21/02 |
| D. 300,446 | 3/1989 | Winters, Jr. | D21/228 |
| 3,384,910 | 5/1968 | Heston, Jr. et al. | 441/65 |
| 3,722,015 | 3/1973 | Miller et al. | 441/65 |
| 4,406,628 | 9/1983 | Rademacher | 434/254 |
| 4,439,165 | 3/1984 | Rothstein | 441/74 |
| 4,561,664 | 12/1985 | Cashmere | 280/18 |
| 4,752,260 | 6/1988 | Stewart | 441/65 |
| 4,781,638 | 11/1988 | Winters, Jr. | 441/129 |
| 4,894,034 | 1/1990 | Brown, III | 441/65 |

*Primary Examiner*—Edwin L. Swinehart

*Attorney, Agent, or Firm*—Kolisch, Hartwell, Dickinson, McCormack & Heuser

[57] ABSTRACT

A bodyboard is provided with a pair of elongate side-rail grip contours formed in the top surface of the board for providing an improved handhold along the side edge of the bodyboard. The grip contour includes a ridge extending from the nose end of the board approximately one-third to four-fifths the length of the bodyboard. Immediately adjacent the ridge is an elongate depression or channel which extends into or below the top riding surface of the bodyboard. The depression is sized to accommodate the thumb of a hand gripping the side edge of the board with the thumb resting comfortably within the channel touching the inner and outer faces of the channel. The grip contour extends from the side edge of the board inwardly toward the center line of the board a distance of between about 2.3-inches to 3.3-inches. The contour is formed by attaching an elongated ridge-piece immediately adjacent each side edge of the core of the board, forming a depression in the foam core immediately adjacent the ridge, and covering both the depression and ridge with the outer skin of the bodyboard.

14 Claims, 3 Drawing Sheets

BODYBOARD WITH SIDE GRIP CONTOUR

BACKGROUND AND SUMMARY OF THE INVENTION

The invention relates generally to sporting goods and recreational products, and more particularly to a bodyboard for use in riding on waves such as ocean surf.

Bodyboards are flotation amusement devices for riding waves. They are similar to surfboards, the major differences being that bodyboards are shorter, lighter and generally more flexible than surfboards. In form, a bodyboard is a contoured, elongated, semi-rigid foam plank having a top riding surface and a plastic bottom skin which is generally slick and somewhat stiff for enhancing planing on the surf.

Bodyboards are traditionally ridden in a prone or procumbent position, with one arm extending forwardly for gripping the nose end of the board, either centrally along the nose or at one of the forward corners of the board. The other arm is generally positioned in a trailing manner, for gripping a side edge of the board. The rider, pushes or pulls against the front and side edges, bending or twisting the board to assist in maneuvering. The rider's legs, which trail the board, also help with steering and maneuvering.

Bodyboarding is a very fast-paced and exhilarating sport, and has evolved to include competitions where tricks and maneuvers requiring a high degree of coordination and aggressiveness are attempted. Maneuvers such as the "el rollo," "belly spinners," and others require daring and precise turns, mandating that a rider have complete control over the board. To maintain such control, a rider must grip the board securely, but this can become a problem because the board is necessarily wet. If the rider's hand slips off the board at an inopportune moment, the result is an aborted or out-of-control ride.

While riding a bodyboard, the rider will often rest some of his weight on the elbow of the forward arm, using the fingers of his forward hand to grip the nose end of the bodyboard and pull upwardly to increase the curvature of the front of the board. When a more secure grip is required, the forward hand is usually shifted to the corner of the nose, where the hand can partly wrap around the side edge of the board. The trailing hand grips the opposite side edge at a point distant from the nose. It is along the side edges of the board that a jaw-like grip between the fingers and thumb of the hand is particularly important.

Bodyboards have been specifically developed to improve the shape of the side edges so they will provide a more secure handhold, for example, the bodyboard disclosed in U.S. Pat. No. 4,894,034, assigned to the assignee of the present invention. In that patent, an elongate ridge is provided along each side edge of the board extending from the nose to an angular offset near the rear of the board. The top riding surface is depressed below the ridge, resulting in a raised edge against which the rider's thumb can rest to improve his grip. The board shown in the patent facilitates handholds in two specific locations adjacent the angular offsets. The elongated ridge extending along the side edges of the patented board are relatively broad and flat and not usable as enhanced-grip handhold by individuals with small hands. It would be advantageous to provide improved handholds for hands of all sizes extending along a greater length of the side edges of the board.

It is an object of the present invention to provide an improved shape or contour for the side edges of a bodyboard to enhance the grip of the bodyboard rider along the side edges.

It is another object of the invention to provide an improved side edge handhold for bodyboards which can comfortably accommodate hands of different sizes to provide a comfortable and sure grip for hands over a broad range of hand sizes.

It is another object of the present invention to provide a bodyboard incorporating gripping contours extending along the side edges of the top surface of the board which facilitate both a strong, sure grip and the comfort of the rider.

Accordingly, the invention provides a bodyboard comprising an elongate, substantially planar board having a top surface for supporting a rider, a bottom surface for planing on water, a front nose end, a rear tail end, and elongate laterally-opposed side edges extending between the nose and tail ends. The bodyboard further includes an elongate grip contour formed in the top surface of the board adjacent each side edge in selected regions of the board. Each elongate grip contour includes a ridge extending above the top surface immediately adjacent the side edges of the board and a depression extending into or below the top surface of the board adjacent the ridge. The elongate grip contour allows the thumb of a hand gripping the side edge to fit comfortably over the ridge and extend into the depression. In its preferred form, the elongate grip contour extends along approximately the forward one-third to four-fifths the length of the board. The preferred bodyboard also includes a beveled edge along each side edge of the board, and the ridge forms an extension of the beveled edge above the plane or level of the top surface.

DETAILED DESCRIPTION OF THE PREFERRED EMBODIMENT

Figure 1:
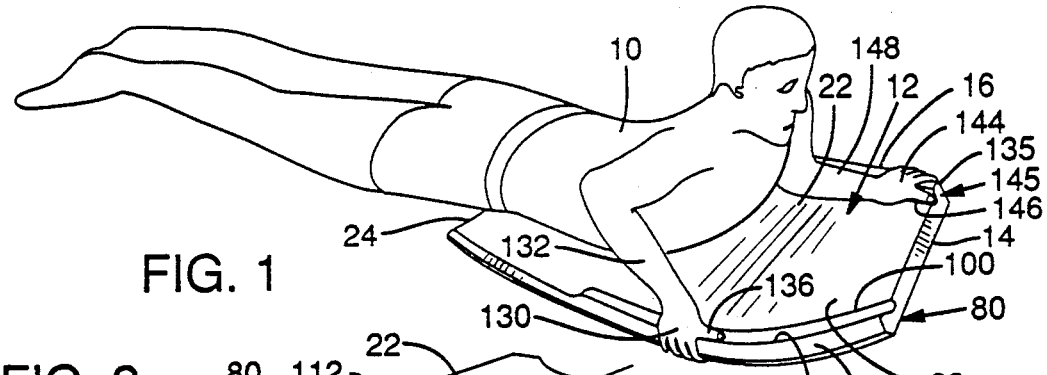
FIG. 1 is a perspective view of a bodyboard rider positioned on a bodyboard, the illustrated riding position being typical for prior art bodyboards as well as for the bodyboard of the present invention.

FIG. 1 shows a bodyboarder 10, also referred to as a bodyboard rider 10, riding a bodyboard 12 in a typical riding position. One arm is extended forwardly gripping the nose end 14 of the bodyboard, while the other arm is disposed in a trailing manner engaging one of the sides 16, 18 of the bodyboard. As illustrated, rider 10 is on his stomach, in a prone or procumbent position, partially propped up on the elbow of the forward left arm with his chest and torso positioned over the top surface 22 of the board. His left hand is gripping the front left corner of the board, along the left side edge, and his right hand is gripping the right side edge at approximately the midpoint of the board. His body extends beyond the tail or rear end 24 of the board with his legs trailing in the water. In this position, the rider steers or maneuvers the board by leaning, use of his legs and manipulation or twisting of the board with his hands and arms.

Figure 2:
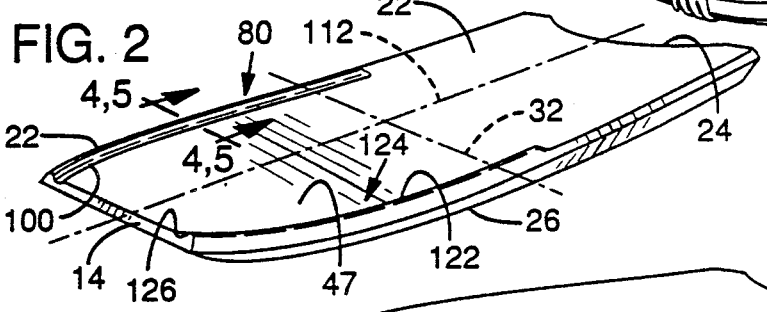
FIG. 2 is a perspective view of the bodyboard of the present invention as viewed from the front left corner of the bodyboard.
Figure 3:
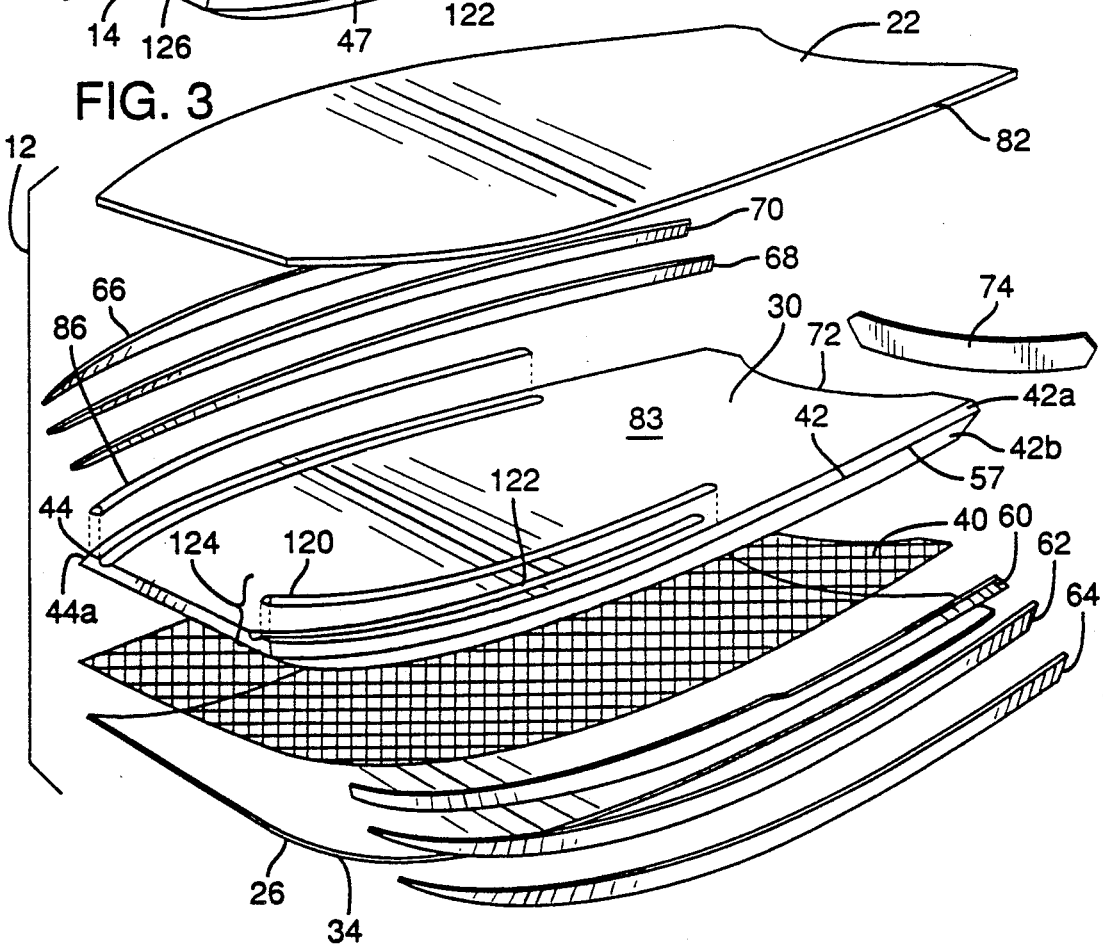
FIG. 3 is an exploded, perspective view of the bodyboard of FIG. 2, on an enlarged scale, showing the various layers and parts of the bodyboard.

The structure of bodyboard 12 is illustrated in greater detail in FIGS. 2 and 3. Bodyboard 12 is an elongate, substantially planar board having a top surface 22 for supporting the rider 10, and a bottom surface 26 for planing on water. The heart of the board structure, constituting a major portion of the interior volume of board 12, is a semi-rigid foam core 30, which generally defines the overall shape of the board and its external surfaces. Foam core 30 is made of a closed cell expanded polyolefin foam, preferably of a type specially fabricated for use in bodyboards. The preferred foam for use in core 30 is called Wavecore (trademark), which is a high quality Ethafoam ® product made by Dow Chemical Company. Foam core 30 is relatively stiff and dense and, although resiliently deformable, will tend to retain its shape if bent or twisted by the rider. In a typical board of approximately 4-feet in length, foam core 30 is 2-inches to 3-inches in thickness at the midpoint or midportion 32 of the board, midway between the nose and tail ends. The thickness of the board tapers downwardly to a smaller thickness adjacent nose end 14. Foam core 30 curves upwardly from the midpoint of the board toward the nose and tail ends, defining nose and tail rockers, which are upwardly curving, planing surfaces on the bottom of the board. A forward-arching concave indentation is formed in the tail end 24 of the board, defining what is known as a swallow tail.

Bottom surface 26 of board 12 is a thin layer 34 of a friction-reducing shiny plastic covering which is generally one-sixteenth-inch or less in thickness, providing a nonfoam planing surface that is tough and resilient. Bottom skin layer 34 is preferably formed of SURLYN ®, a plastic product made by DuPont, backed by a layer of foam such as closed cell expanded polyolefin or Ethafoam ®. The backing foam, which lies just inside the shiny nonfoam plastic outer skin, is generally one-quarter-inch or less in thickness. Typically, the SURLYN ® outer skin and the backing foam are bonded together by the manufacturer and supplied as a unit. Both the nonfoam plastic or SURLYN ® outer skin and the foam backing layer are referred together as bottom skin 34, which extends to the bottom surface 26 of the board.

An intermediate stiffening or reinforcing layer of fiber mesh 40 extends between bottom skin 34 and the underside of foam core 30. Stiffening mesh layer 40 helps resist breakage or creasing of the board by strengthening the bottom skin. Use of such a stiffening layer is described in co-pending patent application Ser. No. 07/656,556, filed Feb. 15, 1991, entitled BODYBOARD WITH STIFFENING REINFORCEMENT, invented by the same inventor as the present invention. Fiber mesh stiffening layer 40 is optional in the bodyboard of the present invention, although its use can be advantageous for the reasons set forth in co-pending patent application Ser. No. 07,656,556, filed Feb. 15, 1991, entitled BODYBOARD WITH STIFFENING REINFORCEMENT.

Figure 4:
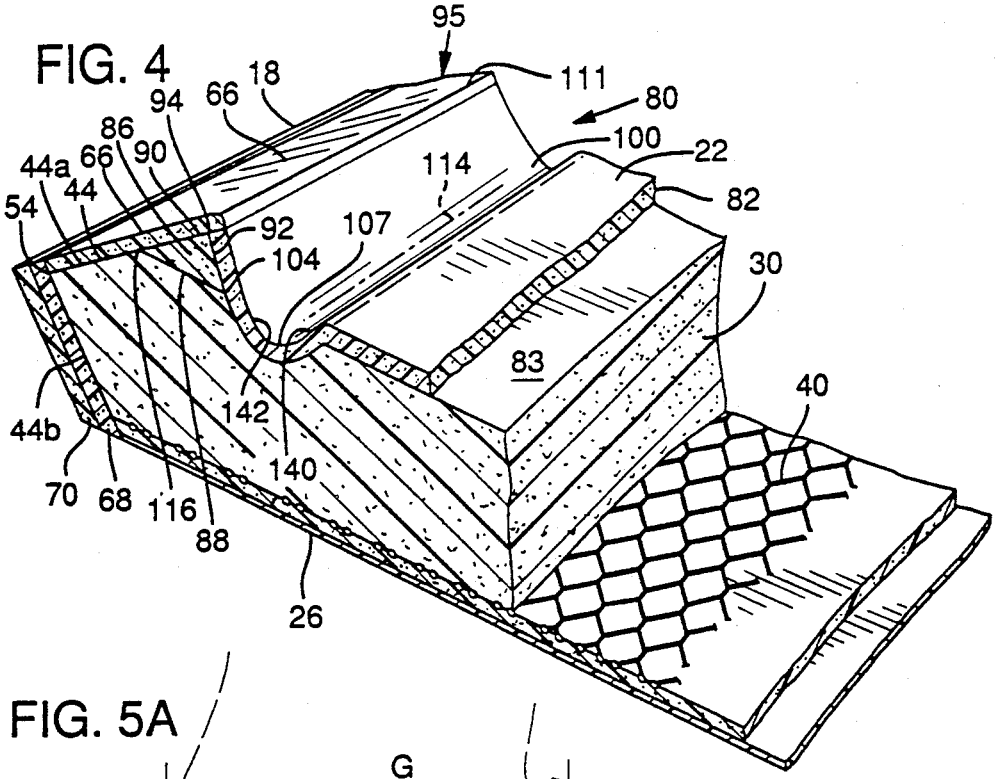
FIG. 4 is a perspective view of a slice of the bodyboard of FIG. 2, on an enlarged scale, taken along the right longitudinal side edge of the bodyboard between section lines 4—4 of FIG. 2, illustrating the layered construction of the bodyboard and the location and structure of the handhold grip contour formed along the edge of the bodyboard.

The side edges 42, 44 of the foam core are preferably beveled to define an outwardly-extending triangular shape on each side edge. Referring to FIGS. 3, 4 and 5, the latter two of which show a portion of the right side edge of bodyboard 12 in cross-section, upper beveled surface **44*a* angles outwardly and downwardly from the plane or level 46 of the top surface of the board. As indicated in FIG. 5, the plane or level 46 of top surface 22 means a plane at the level and approximate orientation of the central top riding surface of the bodyboard in the central, flat region 47 between the grip contours of the present invention, described below. To the extent the central region 47 of top surface 22 includes some curvature or texture, the plane or level 46 of the top surface means a plane positioned and oriented to best average or approximate the level or height of the top riding surface, relative to the rest of the board. Lower beveled surface 44*b* angles outwardly and upwardly from the plane or level 48 of the bottom surface of the board. As indicated in FIG. 5, the plane or level 48 of bottom surface 26 means a plane at the level and approximate orientation of the bottom planing surface of the bodyboard. To the extent the bottom planing surface 26 includes some curvature or texture, the plane or level 48** of the bottom planing surface means a plane positioned and oriented to best average or approximate the level or height of the bottom planing surface, relative to the rest of the board.

Upper beveled surface **44*a* of the right side edge shown in FIGS. 4 and 5 angles outwardly and downwardly from the plane 46 of the top surface of the board at a downward angle 50 of less than 90°. The lower beveled surface 44*b* angles outwardly and upwardly from the plane 48 of the bottom surface of the board, at an upward angle 52 of less than 90°. Upper beveled side edge 44*a* and lower beveled side edge 44*b* extend toward one another and meet along a side edge line 54 extending along the outermost side edge of foam core 30. Left side edge 42 of foam core 30 is a mirror image of the right side edge and, with reference to FIG. 3, includes an upper beveled edge 42*a* extending downwardly and outwardly from the plane or level 46 of the upper surface of the bodyboard at an angle of less than 90°. Lower beveled edge 42*b* extends upwardly and outwardly from the bottom of foam core 30 at an angle of less than 90°. Upper beveled edge 42*a* and lower beveled edge 42*b* thus extend toward one another and meet along an outermost side edge line 57 extending along the left side edge 42 of foam core 30**.

Covering the beveled side edges of foam core 30 are elongate foam or plastic outer skin pieces 60, 62, 64, 66, 68 and 70. These elongate side pieces are preferably formed of closed cell expanded polyolefin foam or Ethafoam ®. Referring to FIG. 3, on the left side edge of the foam core, upper beveled edge **42*a* is covered with chine piece 60, which is attached to the foam core by thermolamination or another suitable technique. Lower beveled edge 44*b* is covered with a two-layer side rail, inner side rail 62 and outer side rail 64. Inner side rail 62 is bonded directly to the lower beveled edge 42*b* of the foam core by thermolamination and the outer side rail 64** is bonded to the inner side rail by a similar bonding technique. Referring to FIGS. 4 and 5, right side edge 44 includes chine-piece 66 bonded to upper beveled edge 44*a* and inner and outer side rails 68, 70, respectively, bonded to lower beveled edge 44*b*. The rear or tail end 72 of foam core 30 is covered with a tail-piece of foam or plastic 74 to cover the rear or tail end 24 of the bodyboard. Each layer of the side edge covering pieces 60, 62, 64, 66, 68, 70 is approximately one-quarter-inch thick. If the colors selected for chine-pieces 60, 66, outer rails 64, 70 and tail-piece 74, contrast with colors selected for the top and bottom skin of the board, they can provide a distinctive appearance to the bodyboard.

One important feature of the present invention is the provision of grip contours formed in the top surface 22 adjacent side edges 16, 18 of the board. Referring to FIGS. 3, 4 and 5, the latter two figures directed specifically to the right side edge of the bodyboard, right side grip contour 80 is a specially-shaped region of the top surface, adjacent the side edge, designed to provide an easily gripped and comfortable handhold. Right side grip contour 80 will be described first, with the understanding that the left side grip contour is a mirror image of the right side grip contour and includes the same structural elements. Grip contour 80 is created by altering the shape of the underlying foam beneath the top skin 82 of the bodyboard and beneath a portion of chine 66 to create an adjacent ridge and depression along the side edge of board.

FIGS. 4 and 5 show the right longitudinal side edge of the bodyboard of FIGS. 1–3, on an enlarged scale. The upper surface 83 of foam core 30 is generally flat, except in the region where an elongate depression is formed, as described below. A ridge-piece 86 is attached to flat upper surface 83 immediately adjacent the line 87 where upper beveled surface 44*a* meets upper flat surface 83. Ridge-piece 86 is an elongate, narrow piece of closed cell expanded polyolefin foam, Ethafoam®, or the like. It has a generally triangular cross-section and its flat bottom wall 88 is bonded to upper surface 83 of the foam core by thermolamination or another suitable bonding technique. Ridge-piece 86 extends along the forward one-third to four-fifth of the bodyboard. In addition to flat base 88, ridge-piece 86 has tapering outer and inner sides 90, 92, respectively, that meet at an apex 94, which is either pointed or rounded. In the preferred embodiment, ridge-piece 86 is between about 0.3-inch and about 0.7-inch wide at base 88, with the preferred base width (dimension A in FIG. 5A) being 0.625-inch, or ⅝-inch.

The angle between the base 88 of ridge-piece 86 and outer side 90 is preferably the same as the angle 50 between upper beveled edge 44*a* and the plane 46 of top surface 22 (plane 46 being parallel to the upper surface 83 of the foam core). That way, outer side 90 forms a continuation of beveled edge 44*a*, above the upper surface 83 of core 30. The top skin 82 of the bodyboard, which covers the upper surface 83 of foam core 30, extends over at least a portion of ridge-piece 86. In particular, top skin 82 covers inner side 92 of ridge-piece 86 up to the apex 94. Ridge-piece 86, together with its outer covering, which includes chine 66 and top skin 82, forms a continuous ridge 95 extending above the level 46 of the top surface of the bodyboard.

Referring to FIG. 5, immediately adjacent ridge 95 is an elongate removed area 101 in the foam core which has generally curving cylindrical sides. The removed area 101 is formed in the upper surface 83 of foam core 30, either by removal of foam material or by heat branding using an elongate heated rod, or by another suitable technique. The outer edge 104 of removed area 101 (the outer edge being the edge farthest from the longitudinal center line of the board) meets and coincides with the inner edge of ridge-piece 86, where inner wall 92 meets bottom wall 88. The angle of inner side 92 of the ridge-piece preferably is continued on the inner wall 106 of removed area 101 to provide a smooth transition between the ridge-piece and removed area 101. The bottom of the elongate, cylindrical removed area has a radius R (FIG. 5A) of approximately three-quarters-inch. The inner wall 108 of removed area 101 extends downwardly into the upper surface 83 of foam core 30 from the flat central expanse of upper surface 83. The result is an elongate removed area 101 in foam core 30 which has sloping inner and outer walls and a curved or radially-curved bottom or lowest point 107 extending along a line spaced from the side edge of the bodyboard.

To complete the grip contour 80, top skin 82 is applied over the upper surface 83 of foam core 30, extending into removed area 101 and up to or over the apex 94 of ridge-piece 86. As shown in FIGS. 4 and 5, top skin layer 82 extends to the apex 94 of the ridge-piece, where it joins chine piece 66. Since top skin 82 and chine piece 66 are each approximately one-quarter-inch thick, the skin and chine together raise the top surface 22 of the board approximately one-quarter-inch above the upper surface foam core 30 and ridge-piece 86. The final grip contour 80 has the same overall shape as the underlying contour formed by foam core 30, removed area 101, and ridge-piece 86.

Figure 5A:
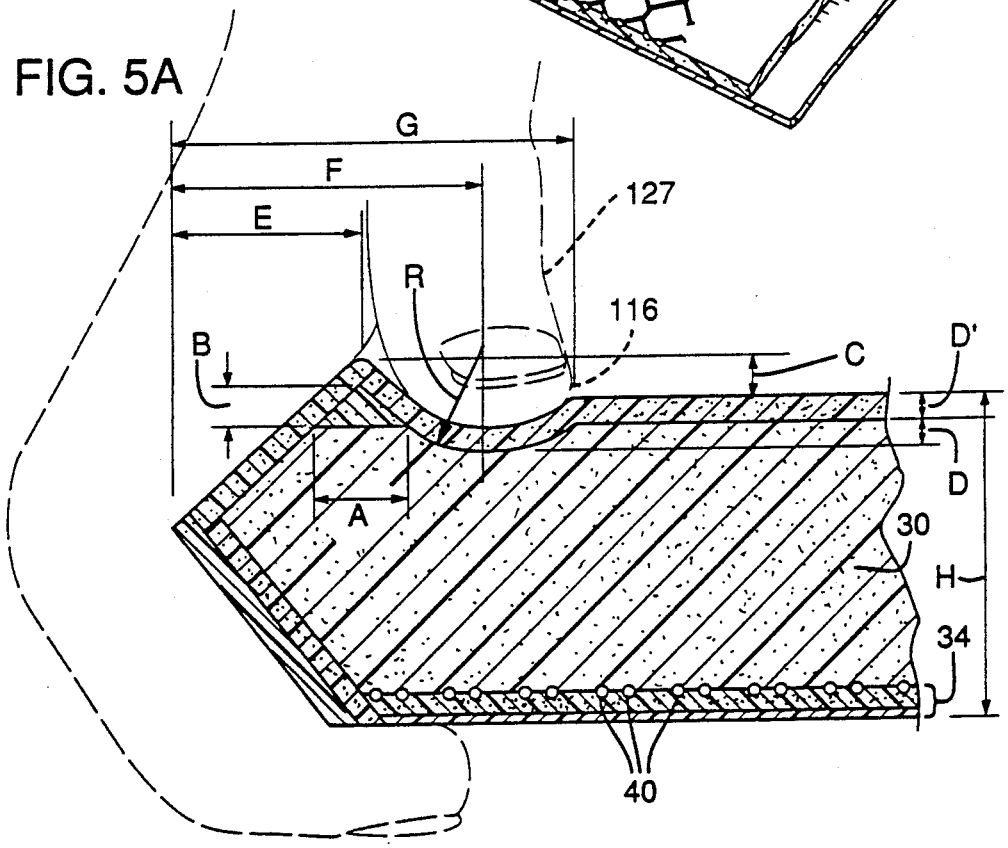
FIG. 5A is a side cross-sectional view as in FIG. 5 identifying selected dimensions on the right side grip contour and showing in phantom a hand gripping the bodyboard.
Figure 5:
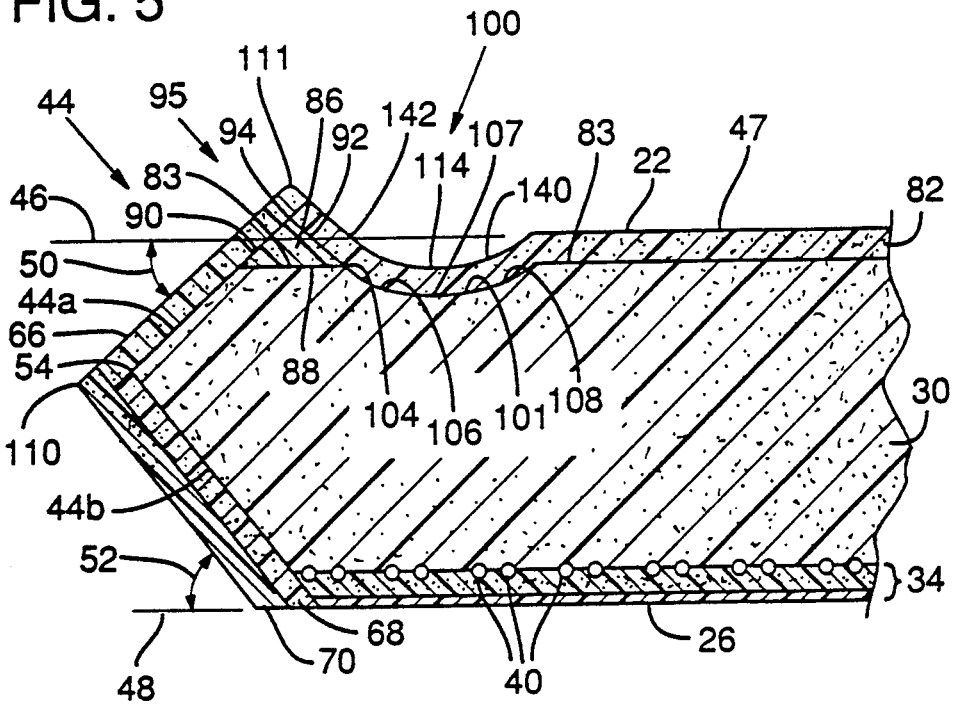
FIG. 5 is a side cross-sectional view taken along line 5—5 of FIG. 2 illustrating the structure of the right side edge of the bodyboard of FIGS. 1–3.

Referring to FIGS. 5 and 5A, the preferred embodiment right side grip contour 80 has the following preferred dimensions. Ridge-piece 86 has a width A along bottom wall 88 of between about 0.3-inch and 0.7-inch, with the preferred base dimension being 0.625-inch (⅝-inch). The overall height B of ridge-piece 86 is between about 0.06-inch and about 0.5-inch, with the preferred height being 0.25-inch (¼-inch), above the upper surface 83 of foam core 30. The overall height of ridge 95 above the level 46 of top surface 22 is approximately equal to the overall height B of ridge-piece 86. Consequently, the ridge 95 in top surface 22 extends above the level 46 of the central part of the top surface between about 0.06-inch and about 0.5-inch, with the preferred height C of ridge 86 being 0.25-inch (¼-inch).

Depression or channel 100 is the depression formed in top surface 22 of the bodyboard adjacent ridge 95. The depth D of removed area 101, below upper surface 83 of foam core 30, is preferably in the range of about 0.1-inch and about 0.5-inch, with the preferred depth D being 0.25-inch (¼-inch). Once top skin layer 82 is applied over the foam core, the elongate depression 100 generally conforms to the size and shape of removed area 101, raised by the thickness of top skin layer 82. Accordingly, the depth of elongate depression (channel) 100 is in the range of about 0.1-inch and about 0.5-inch, with a preferred channel depth D′ being 0.25-inch (¼-inch). The width of depression or elongate channel 100 is between about 0.5-inch and about 2.0-inches, with the preferred width being 1.5-inches.

Other important dimensions for grip contour 80 include the distance the ridge and depression are from the nearest side edge of the bodyboard. Referring to FIG. 5, the outermost right side edge 110 of the bodyboard is that portion of side edge 18 spaced furthest from the longitudinal central line 112 (see FIG. 2) of the bodyboard. Thought of in another way, the longitudinal edge line 110, where the beveled sides of the bodyboard meet, represents the outermost point of side edge 18. The locational dimensions discussed below are measured from that outermost point of the side edge. The apex 111 of ridge 95 is preferably spaced from the outermost point 110 of the adjacent side edge of the bodyboard a distance of about 1.0-inch to about 2.0-inches, with the preferred distance E between side edge 110 and the ridge apex 111 being 1.25-inches ($1\frac{1}{4}$-inches). The preferred distance F between the nearest side edge 110 of the bodyboard and the bottom 114 of depression or channel 100 (the bottom 114 being centrally located at the lowest point is the channel) is between about 2.0-inches and 3.0-inches. The preferred spacing F between the nearest side edge 110 and the bottom 114 of channel 100 is 2.25-inches ($2\frac{1}{4}$-inches). The overall width G of the contoured side edge 80, from the outermost point 110 of the nearest side edge to the innermost line 116 where channel 100 joins the central portion 47 of top surface 22, is in the range of about 2.5-inches and about 3.5-inches, with the preferred overall width of the contoured side edge G being approximately 3.0-inches. For scale, the overall thickness H of the central region of bodyboard 12 is between about 2-inches and about 3-inches.

A mirror image of the right side grip contour 80 shown in FIGS. 4 and 5 is provided along left side edge 16. Referring to FIG. 3, a ridge-piece 120 is attached to the upper surface 83 of foam core 30 and a channel 122 extends into the upper surface of the foam core adjacent the ridge-piece. The result is a grip contour 124 which includes a ridge 125 and adjacent channel 126 formed in top surface 22 adjacent the left side edge of the board. The remainder of the elements of left side grip contour 124 will not set forth as they are the same as a mirror image of the elements and dimensions of right side grip contour 80. Both the right and left side edge grip contours have equivalent dimensions as discussed above in connection with FIG. 5A.

The width and depth of the elongate depressions 100, 122 of grip contours 80, 124, respectively, provide a comfortable fit for the thumb of a hand gripping the side edge of the bodyboard. Each elongate depression 100, 122 is sized to receive the thumb in the manner shown in phantom at 136 in FIG. 5A. Referring to FIGS. 5 and 5A, right side grip contour 80 includes depression 100, which has an inner face 140, closest to the longitudinal center line 112 of the bodyboard, extending downwardly into the depression from top surface 22. Depression 100 also has an outer face, more distant from the center line of the bodyboard, which extends downwardly into the depression from ridge 95. Depression 100 is sized to receive the thumb 136 of a hand 130 gripping the side edge of the bodyboard, as shown in phantom in FIG. 5A, with the thumb resting against the inner and outer faces 140, 142 of the depression, respectively. In other words, the depression is narrow enough for a normal-sized, or even a small-sized human thumb to fit comfortably within the depression, touching both walls of the depression. In that way, depression 100 centrally positions the thumb within the depression and prevents slippage or movement of the thumb except when the rider releases his grip to reposition his hand.

For example, bodyboarder 10 shown in FIG. 1, uses his right hand 130 of trailing right arm 132 to grip bodyboard 12 in a region of the board which includes right side grip contour 80. The fingers and palm of hand 130 extend along side and over right side edge 18 of the bodyboard. The rider's thumb 136 (also shown in phantom in FIG. 5A) fits comfortably over ridge 95 and extends into elongate depression 100, providing a secure, comfortable grip on the bodyboard.

The grip contours 80, 124 extend approximately one-third to four-fifths the length of the bodyboard, from rearward of midpoint 32, to the nose end 14 of the bodyboard. It is particularly advantageous that both the ridge and depression of the right and left side grip contours extend all the way to the nose end 14 of the board because they assist in gripping the nose. For example, the bodyboard rider shown in FIG. 1 is gripping the left forward corner 145 of the board by engaging grip contour 124 with his left hand 144, while resting some weight on forward arm 148. His forward hand 144 is engaging the grip contour in same way as a mirror image of hand 130 shown in phantom in FIG. 5A. In that position, the thumb 146 of the forward hand rests comfortably and snugly within depression 126 (FIG. 2).

Because ridges 95, 122 are relatively narrow, the grip contours of the present invention are easily grasped by large and small hands. The ridges are also positioned close to the side edges of the board, in comparison with the relatively broad edge ridges used in the handholds shown in U.S. Pat. No. 4,894,034. That makes it easier for smaller hands such as children's hands to securely grip the side edges of the bodyboard. The relatively narrow width of the elongate depressions used in the grip contour of the present invention discourages side slippage of the thumb, providing a well-positioned, secure handhold. The grip contour of the present invention is designed to position the hand advantageously for a secure grip on the bodyboard necessary for performing the fast-paced maneuvers and turns which are most exhilarating and challenging.

Alternative embodiments of the grip contour are possible within the scope of the present invention. The grip contour could be provided along the entire length of the side edges of the bodyboard, for example. Alternatively, shorter segments of grip contour could be formed in the bodyboard structure along the side edges of the top surface in selected regions only, rather than along the entire forward one-third to four-fifths of the bodyboard. The elongate depressions in the foam core of the bodyboard may be formed by the building up one or more layers of laminated foam pieces on the upper surface of the core to form channel-shaped depressions, rather than by removing foam material from the core, as will be well understood. The grip contour can be employed in alternative forms of bodyboards such as reinforced, stiffened bodyboards in accordance with patent application Ser. No. 07/656,556, filed Feb. 15, 1991, entitled BODYBOARD WITH STIFFENING REINFORCEMENT, or on unreinforced, unstiffened bodyboard. These and other alternative bodyboard constructions incorporating the above-described side edge grip contour are possible within the scope of the present invention.

The invention provides an improved shape or contour for the side edges of a bodyboard to enhance the grip of the bodyboard rider. The invention provides an improved side edge handhold for bodyboards which can accommodate hands of different sizes to provide a comfortable and sure grip over a broad range of hand sizes. The invention provides a bodyboard incorporating gripping contours extending along the side edges of the top surface of the board which facilitate a strong, sure grip and the comfort of the rider.

While the present invention has been shown and described with reference to the foregoing preferred embodiment, it will be apparent to those skilled in the art that other changes in form and detail may be made without departing from the scope and spirit of the invention as defined in the appended claims.

What is claimed is:

1. A bodyboard comprising:

an elongated, substantially planar board having a top riding surface for supporting a rider, a bottom surface for planing on water, a front nose end, a rear tail end, and elongate, laterally-opposed side edges extending between the nose and tail ends, wherein each side edge of the board is beveled to include an upper beveled surface which angles outwardly and downwardly relative to the top riding surface of the board and a lower beveled surface which angles upwardly and outwardly relative to the bottom surface, the beveled surfaces defining an outwardly extending triangular shape, and including grip contours in selected regions along the side edges of the board, each grip contour forming a side edge which generally matches the inside shape of the fingers and palm of a hand gripping the side edge to provide a comfortable handhold, including a ridge on the top surface adjacent the side edge extending above the top riding surface of the board, one side of the ridge forming a continuation of the upper beveled side edge of the board which extends to the apex of the ridge, and including a depression adjacent the ridge extending below the top riding surface of the board, the depression being sized to receive the thumb of a hand gripping the side edge within the depression.

2. A bodyboard as in claim 1 in which each grip contour extends along selected regions of each longitudinal side edge to the nose end of the board and intersects the nose end adjacent the forward corner where the side edge meets the nose end, thereby providing a grip contour at each forward corner of the board.

3. A bodyboard as in claim 1 in which the grip contours extend adjacent each side edge along approximately the forward one-third of the longitudinal length of the board.

4. A bodyboard as in claim 1, in which the ridge on the top surface has a generally triangular cross section.

5. A bodyboard as in claim 1 in which the apex of the ridge on each grip contour extends above the level of the top riding surface of the board between about 0.06-inch and about 0.5-inch.

6. A bodyboard as in claim 1 in which the apex of the ridge is spaced from the adjacent side edge between about 1.0-inch and about 2.0-inches.

7. A bodyboard as in claim 1 in which the depression is an elongate channel extending into the top riding surface, the bottom of the channel extending along a line which is spaced from the nearest side edge of the board between about 2.0-inches and about 3.0-inches.

8. A bodyboard as in claim 7 in which the elongate channel is between about 0.5-inch and about 2.0-inches in width.

9. A bodyboard as in claim 8 in which the depression is an elongate channel extending into the top riding surface, the bottom of the channel extending along a line which is spaced from the apex of the adjacent ridge between about 0.7-inch and about 1.4-inches.

10. A bodyboard as in claim 1 in which the depression is between about 0.1-inch and about 0.5-inch in depth.

11. A bodyboard as in claim 1 including two grip contours on the board, one adjacent each side edge of the board, the width of each grip contour, including the ridge and depression is between about 2.5-inches and about 3.5-inches.

12. A bodyboard as in claim 1 in which the board includes a semi-rigid foam core having an upper surface covered with a top skin which extends to the top riding surface of the board, including an elongate ridge-piece bonded to the upper surface of the core adjacent the side edge, whereby the ridge-piece contributes to the height of the ridge.

13. A bodyboard as in claim 1 in which the height of the ridge above the level of the top riding surface and the depth of the depression below the level of the top riding surface are approximately equal.

14. A bodyboard comprising:

an elongate, substantially planar board having a top surface for supporting a rider, a bottom surface for planing on water, a front nose end, a rear tail end, elongate, laterally-opposed side edges extending between the nose and tail ends, and a semi-rigid foam core having an upper surface covered with a top skin which extends to the top surface of the board, and a grip contour formed in the top surface adjacent a side edge, including an elongate ridge-piece formed of semi-ridge foam, the rigid-piece having generally triangular cross section, the downwardly relative to the top riding surface of the board and a lower beveled surface which angles upwardly and outwardly relative to the bottom surface, the beveled surfaces defining an outwardly extending triangular shape, and including grip contours in selected regions along the side edges of the board, each grip contour forming a side edge which generally matches the inside shape of the fingers and palm of a hand gripping the side edge to provide a comfortable handhold, including a ridge on the top surface adjacent the side edge extending above the top riding surface of the board, one side of the ridge forming a continuation of the upper beveled side edge of the board which extends to the apex of the ridge, and including a depression adjacent the ridge extending below the top riding surface of the board, the depression being sized to receive the thumb of a hand gripping the side edge within the depression.

* * * * *